US005150851A

United States Patent [19]

Manusch et al.

[11] Patent Number: 5,150,851

[45] Date of Patent: Sep. 29, 1992

[54] CLUTCH FOR TAPE DISPENSER

[75] Inventors: Cristoph Manusch, Hemmingen; Hans-Jurgen Harp, Hanover, both of Fed. Rep. of Germany

[73] Assignee: Pelikan Aktiengesellschaft, Hanover, Fed. Rep. of Germany

[21] Appl. No.: 653,853

[22] Filed: Feb. 2, 1991

Related U.S. Application Data

[63] Continuation of Ser. No. 431,608, Nov. 3, 1989, abandoned.

[30] Foreign Application Priority Data

Nov. 5, 1988 [DE] Fed. Rep. of Germany ... 8813861[U]

[51] Int. Cl.[5] ..... B65H 75/34

[52] U.S. Cl. ..... 242/68.1; 242/68; 464/37

[58] Field of Search ..... 464/37, 41, 42, 83, 464/84, 85, 38; 192/56 R; 242/68.1, 67.1, 68.2, 68, 68.3, 67.1, 68, 68.3

[56] References Cited

U.S. PATENT DOCUMENTS

| | | | |
|---|---|---|---|
| 25,911 | 4/1904 | Toler | 464/42 |
| 2,685,812 | 8/1954 | Dmitroff | 464/37 X |
| 2,706,388 | 4/1955 | Potgieter | 464/37 |
| 2,826,107 | 3/1958 | Woods | 464/37 X |
| 2,909,047 | 10/1959 | Walterscheid | 464/37 X |
| 3,373,865 | 3/1968 | Hollins | 225/47 |
| 3,837,591 | 9/1974 | Clarke | 242/68.2 X |
| 4,004,506 | 1/1977 | McInery | 464/37 X |
| 4,718,971 | 1/1988 | Summers | 156/540 |
| 4,766,641 | 8/1988 | Daglow | 464/37 X |
| 4,878,880 | 11/1989 | Williams | 464/37 |

FOREIGN PATENT DOCUMENTS

| | | | |
|---|---|---|---|
| 0368078 | 5/1990 | European Pat. Off. . | |
| 692761 | 6/1940 | Fed. Rep. of Germany | 464/37 |
| 753947 | 8/1956 | United Kingdom | 464/37 |
| 2125908 | 3/1984 | United Kingdom | 464/37 |

*Primary Examiner*—Stuart S. Levy
*Assistant Examiner*—Joseph A. Rhoa
*Attorney, Agent, or Firm*—Herbert Dubno; Andrew Wilford

[57] ABSTRACT

A tape dispenser comprises a housing, a reel core (3) rotatable in the housing about an axis and having an inner periphery formed with an annular array of inwardly directed core teeth (17), and a drive wheel rotatable in the housing about the axis. A plurality of elastically deformable spring tongues (15) formed unitarily with each other each extend at an angle to the axis from the respective inner end fixed to the drive wheel to a respective outer end lying within the reel core adjacent the inner periphery thereof. Each inner end is axially offset and radially inwardly offset from the respective outer end and each outer end is integrally formed with at least one tongue tooth engaging between the core teeth. A supply of tape (14) is wound on the reel core such that when the tape is payed out or wound up on the reel core same rotates relative to the drive wheel and the core teeth move angularly relative to the tongue teeth with elastic inward deflection of same.

16 Claims, 3 Drawing Sheets

CLUTCH FOR TAPE DISPENSER

CROSS REFERENCE TO RELATED APPLICATION

This application is a file-wrapper-continuation of copending patent application Ser. No. 431,608 filed 03 Nov. 1989, now abandoned.

FIELD OF THE INVENTION

The invention relates to a slip clutch between the reel core of a winding reel of an office device or the like and a driving or gear wheel arranged concentrically thereto and carrying, fixed or its rotation axis and uniformly distributed around same, radially outwardly projecting and radially inwardly deflectable elastic catches with the same shape, whose free ends are in locking engagement with locking receptacles distributed over the inner circumference of the reel core.

BACKGROUND OF THE INVENTION

Particularly in the case of office devices in which a coated tape is drawn from a dispenser reel and after giving up its coating (e.g. an adhesive film, cover-up film, etc.) must be wound in uncoated form back onto the take-up reel in the device, due to the not only constantly varying, but also reciprocally different speeds of the two reels there is a need to provide between same a driving gear and to compensate for the speed differences which occur by the use of a suitable slip clutch between one of the reels and the associated driving or gear wheel. Due to the constricted space available in office devices use is generally made of slip clutches coaxial to the corresponding reel core.

In a conventional form for such slip clutches, the driving or gear wheel has a centrally projecting spindle portion which projects through a central opening of a central king pin fitted to the associated reel in such a way that it projects axially out of said opening at its end. To said projecting end is fixed a metal clip whose two side legs engage from the outside over the reel king pin and engage under pretension resiliently against its outer face. As a result of this metal clip connected rigidly in the rotation direction to the driving or gear wheel a connection by frictional resistance is created between its resilient legs and the reel king pin, which acts as a slip clutch, if there is a relative speed difference between the reel and the driving or gear wheel. Such a solution is described in U.S. Pat. No. 4,718,971. However, these slip clutches are relatively complicated to assemble, which particularly applies in the case of automatic assembly and this constitutes their main disadvantage. In addition, they are expensive from the material standpoint, because it is generally necessary to use metal clips as spring elements. To ensure that when using such an office device in which a film, such as an adhesive film, has to be transferred from a carrier foil to a substrate, at the end of application the film coating is removed from the tape (i.e. separated from the film coating still left on the tape) without undesirable further movement taking place to the reels, this would mean in the case of such slip clutches that the pretension of the metal clip would have to be so strong that continuous tape unwinding would be very difficult. This disadvantage is obviated in the known devices in that a number of locking/unlocking means separate from the slip clutch are provided and are either operated by the user by pressing on a button on the casing and then disengaging the reels or, as in U.S. Pat. No. 4,718,971, by the springing out of the application foot releasing the locking action in use counter to the effect of a back-tension spring. Metal springs have a relatively large dispersion in manufacture, so that the correct operation of such slip clutches presupposes that from the outset a relatively large pretensioning of the metal springs must be ensured, so that an adequate pretension is always obtained even for minimum values out of the tolerance range. If an undesired lubrication occurs between the legs of the metal clip and the smooth engagement surface of the associated king pin, there is a marked, sudden reduction of friction, which can in turn lead to an undesired easy action of the force closure. The known slip clutch is unable to compensate angular variations between the pivot pins of the reel and the gear wheel.

Similar disadvantages occur in another known solution, where use is made of a "spring belt" gear between the two reels, whose spring belts slips in the case of an unequal speed of the reels. Although here minor angular variations can be compensated, the disadvantages resulting from frictional resistance grip persist and assembly is complicated.

DE-OS 36 38 722 discloses a coaxially acting slip clutch in which a clutch cover whose internal diameter is provided with all-round grooves or serrations is in locking engagement with the ends of thin elastic angle catches projecting radially outwards from the clutch wheel. The reel with the core is mounted on this clutch cover, so that drivers constructed on the latter engage in suitable slots inside on the reel core. The disadvantages linked with a slip clutch operating purely by frictional resistance are admittedly avoided in this known slip clutch, but it has a complicated assembly, which more particularly applies for the fitting of the elastic, radial catches, especially in the case of automatic assembly. In addition, the known slip clutch is expensive from the material standpoint due to the large number of components used and is therefore relatively expensive to use in general terms. However, it is not able to compensate even a minor angular displacement between the pins of the reel and the driving wheel.

OBJECT OF THE INVENTION

The problem of the present invention is therefore to so further develop a slip clutch of the aforementioned type, that it can be assembled more simply and rapidly, can be manufactured with reduced costs, is less expensive and is in particular suitable for compensating an angular displacement between the pivot pins of the reel and the driving or gear wheel.

SUMMARY OF THE INVENTION

According to the invention this is achieved in the case of a slip clutch of the aforementioned type in that the elastic catches are constructed in the form of axially extending, radially outwardly sloping spring tongues projecting from the driving or gear wheel into the reel inner area surrounded by the reel core and provided at their ends with in each case at least one radially outwardly directed locking tooth. The locking teeth engage with a corresponding inner tooth system on the reel core and the spring tongues either are constructed in one piece with the driving or gear wheel or with a supporting disk coaxially fixed thereto.

In the case of the slip clutch according to the invention the axially directed, radially outwardly projecting spring teeth act directly on an inner tooth system on the reel core without the interposing of a clutch cover or the like, so that there is a significant material saving compared with the solutions of the prior art. The construction of the locking devices in the form of locking teeth on the one hand and the inner tooth system on the reel core on the other ensures precisely definable engagement conditions in the locking zone, which not only leads to a very effective and precisely determinable locking effect, but enables specific locking actions to be achieved if they are desired. As a result of the inventive construction of the spring tongues and the resulting engagement situation on the inner tooth system of the reel core, there is also a possibility of compensating without difficulty any desired or undesired angular displacement between the pivot pins of the reel core and the driving or gear wheel, without impairing the desired slip clutch action, which always simplifies assembly. In the case of the inventive slip clutch, in the case of a one-piece construction of the spring tongues or catches and the driving or gear wheel, there is no need for a separate fixing thereof, so that the inventive construction of this one-piece component is simple to manufacture. However, if the elastic tongues or catches are constructed in one piece with a supporting disk, which is in turn fixed concentrically to the driving or gear wheel, then here again the individual fixing of each tongue or catch is no longer necessary and it is only necessary instead to fix a supporting disk to be fitted concentrically to the driving or gear wheel, which also causes no problems during automatic assembly. As the elastic tongues with their locking teeth engage directly in the inner tooth system on the reel core of the reels to be mounted, there is no intermediate member and consequently the material, manufacturing and assembly costs for the same are obviated. The mounting of the reel with its inner tooth system on the spring tongues only involves an axial slipping on process, which can be easily and rapidly performed in the case of automatic assembly, so that the overall assembly of the inventive slip clutch is surprisingly simple and can therefore take place surprisingly rapidly, the total material and manufacturing costs being low. Therefore a particularly inexpensive construction is achieved. The use of locking teeth constructed at the ends of the spring tongues and an inner tooth system corresponding thereto causes no problems from the manufacturing standpoint, but ensures precisely defined engagement conditions during locking engagement allowing a precise design with respect to the desired release moments of the slip clutch. This obviates chance action and also leads to the obtaining of special slip clutch effects, to which further reference will be made hereinafter.

The construction of the locking teeth and the teeth of the inner tooth system can take place in any form suitable for locking engagement. However, in particularly preferred manner the locking teeth and the teeth of the inner tooth system are shaped in such a way that they have a symmetrical tooth cross-section, which can give a locking coupling effect in both rotation directions. The symmetrical construction of the teeth is preferably triangular in cross-section and advantageously the tooth profiles or flanks of each tooth form an angle of approximately 120°.

An advantageous further development of the inventive slip clutch comprises the teeth of the inner tooth system of the reel core having a larger and preferably three times as large tooth height as the locking teeth of the elastic tongues, which leads to a definite reduction in the wall thickness of the reel core, which leads to a further, marked material saving with respect thereto.

However, in connection with the inventive slip clutch, it can be advantageous in certain cases to adopt an assymmetrical construction of the teeth of the inner tooth system of the reel core and the locking teeth, so as to obtain different opening moments for the locking release moment in both rotation directions. A preferred assymmetrical construction of the teeth comprises the teeth of the inner tooth system of the reel core and the locking teeth having a radially extending side flank, whilst the other side flank is set at an angle thereto which is preferably 60°. In the case of this construction of the inventive slip clutch the desired slip clutch effect is obtained only in one rotation direction, whereas in the other rotation direction when the radially directed flanks of the two tooth rows rest on one another, fundamentally a locking effect is obtained without any slip effect. In the case of this tooth design, it is also ensured that following the maximum springing in of the elastic locking teeth, when the inner teeth slip over the particular opposite locking tooth there can immediately be a radial springing out of the locking teeth without, unlike in the case of a symmetrical tooth cross-section, under the tension of the carrier tape, there being an accelerated sliding down of the outer tooth system on the inclined flank thereof following the crest of the locking tooth (under the action of the radially outwardly directed restoring force of the locking tooth) and consequently to the occurrence of an undesired, sudden tape slackening.

Preferably, in the case of the slip clutch according to the invention, the pitch of the inner tooth system is smaller than half the width of the end portion of a spring tongue carrying the locking teeth, so that considered circumferentially a one-sided springing out of an individual tongue can be avoided, because always at least two teeth of the inner tooth system are in engagement with the locking teeth of the spring tongue.

In place of a triangular design of the teeth, they can also be constructed with a symmetrical cross-section in the form of a circular segment, so that the inner tooth system has a corresponding complimentary shaping, which can be particularly advantageous in certain cases.

Advantageously the reel core with the inner tooth system and the spring tongues with the locking teeth are made from plastic, which not only leads to easy manufacture of the individual components, but also brings about favourable friction ratios in the area of the locking engagement (plastic/plastic).

The spring tongues are arranged concentrically about the rotation axis or pivot pin of the driving or gear wheel and their portions arranged between the locking teeth and the driving or gear wheel preferably rest with their radial outer faces on the circumferential surface of a truncated cone. Advantageously, in this area the spring teeth are provided with a cross-section radially tapering towards the driving or gear wheel, which leads to a favourable springing out behaviour and simultaneously a stable overall arrangement. In particularly preferred manner the spring tongues are provided on their end region carrying the locking teeth with a thickened cross-section.

Preferably the teeth of the inner tooth system are substantially fitted over the entire axial width of the inner area of the reel core and also in preferred manner the locking teeth on the end region of the tooth system located internally in the reel core are in engagement therewith, so that the force transfer brought about at the locking point can take place in the vicinity of the casing-side bearing point of the reel.

It is also advantageous, if, circumferentially, the distance between two spring tongues is smaller than the pitch, that is angular dimension, of the inner tooth system, which ensures that there is no more than one unloaded tooth of the inner tooth system between two spring tongues.

Practical tests have shown that in the case of the slip clutch according to the invention, the pitch of the inner tooth system is preferably three times as large as that of the locking teeth on the spring tongues, which leads to very good results.

BRIEF DESCRIPTION OF THE DRAWING

The invention is described in greater detail hereinafter relative to non-limitative embodiments and the attached drawings in which.

SPECIFIC DESCRIPTION

Figure 1:
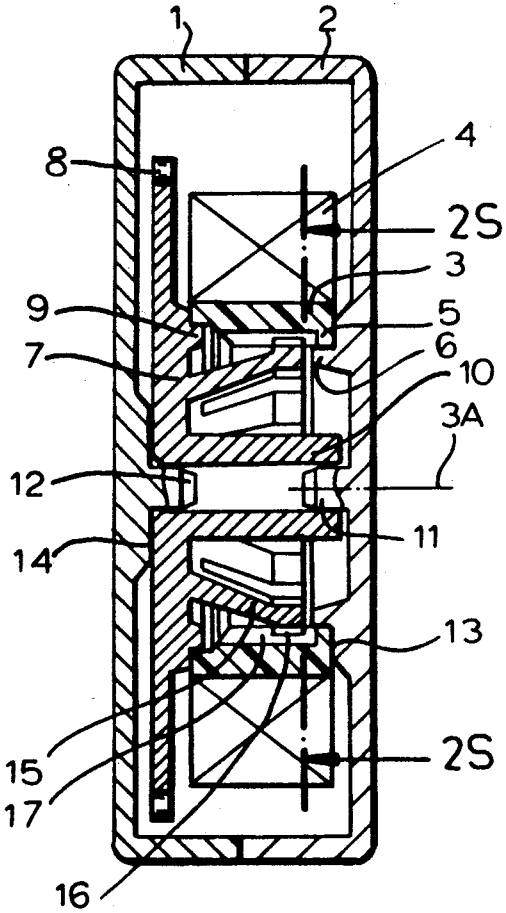
FIG. 1 is a cross-section through the casing of a manual adhesive roller through the dispenser reel arrangement thereof and with an inventive slip clutch.

FIG. 1 is a section through the casing of an office adhesive roller formed from two casing halves 1,2, with which an adhesive film applied to a carrier tape can be transferred to a substrate. The film-coated carrier tape is on a dispenser reel fitted to the casing and in the form of a tape supply 4 (cf. FIGS. 1 and 2) wound onto a reel core 3 and from it it is drawn to one side for use purposes (as shown by dot-dash lines and an arrow in FIG. 2). At another point within the casing 1,2 is provided a not shown take-up reel onto which the film-coated carrier tape drawn out of the casing is wound up in the latter again following the delivery of the adhesive film.

As is also shown in FIG. 1, the core 3 of the dispenser reel is mounted in rotary manner on a bearing collar 6 via a support wall 5 retaining in rotary manner the reel core 3 and fitted to an axial end facing the casing side wall and which is constructed on a butting collar 13 projecting from the side wall of the casing half 2 into the interior of the casing.

Coaxially with the core 3 of the dispenser reel a toothed wheel 7 with an external tooth system 8 is provided on the facing casing half 1, which carries on its side facing core 3 an all-round collar 9 on which is located the free end of reel core 3.

From toothed wheel 7 projects a centrally positioned, hollow central shaft 10 which extends through the entire open width of the casing formed by casing halves 1 and 2 and its two axial ends are mounted in rotary manner on short bearing pins or trunnions 12, 11 projecting out of the particular casing half 1 or 2. The outer face of toothed wheel 7 facing the casing half 1 is axially supported against a circular butting collar 14 passing concentrically about the trunnion 12.

On the side facing the reel core 3 to the toothed wheel 7 are formed a plurality of uniformly angularly equispaced spring tongues 15, which are outwardly displaced with respect to the central shaft 10 thereof and which are arranged concentrically to the latter, are constructed in one piece therewith and all have the same shape. Each spring tongue 15 extends axially in the direction of the rotation axis of toothed wheel 7, but not parallel thereto and rises in radially outwardly sloping manner starting from its issuing point on wheel 7. The outer faces of all the spring tongues 15 are consequently located on a truncated cone-shaped surface.

Figure 2:
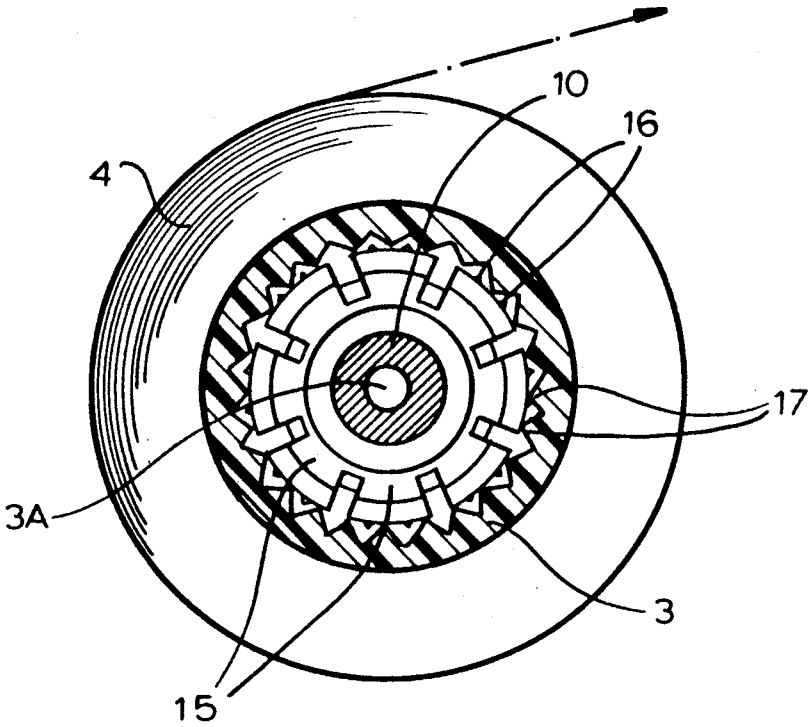
FIG. 2 is a section taken along line 2S—2S of FIG. 1 with the casing removed for clarity of view.

On their axial ends, the spring tongues 15 are provided with at least one locking tooth 16 which projects radially outwards. In the embodiment shown in FIGS. 1 and 2, there are in each case two locking teeth 16 per spring tongue 15, as shown in FIG. 2. These radial locking teeth 16 engage with corresponding opposite teeth of an inner tooth system 17 which is constructed on the inner circumference of reel core 3. The axial extension of the spring tongues 15 is so large that they only engage in the inner tooth system 17 of core 3 at a small axial distance from the front end of the bearing collar 6 projecting from the opposite casing half 2. Thus, the force transfer between the teeth 16 and 17 is axially moved into an area very close to the casing-side bearing point of core 3, so that the tilting moments caused by the axial spacing of the locking engagement point from this bearing point resulting from the tooth support forces and occurring on the casing-side mounting of the dispenser reel or its core 3 can be kept very small.

Figure 3:
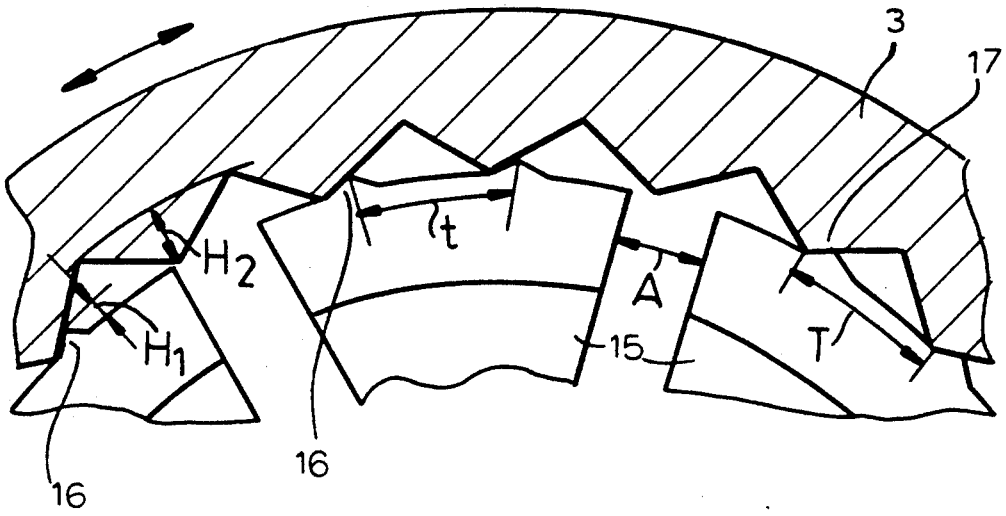
FIG. 3 is a much larger scale detail of FIG. 1 in the area of the tooth engagement of the locking teeth with the inner tooth system of the reel core.

The locking teeth 16 and the opposite teeth of the inner tooth system 17 of reel core 3 are, in the embodiment according to FIG. 2, in each case provided with symmetrical cross-section. FIG. 3 shows a greatly enlarged detail from FIG. 2 to better show the reciprocal tooth engagement and the tooth shapes.

In this embodiment both the locking teeth 16 on the spring tongues 15 and the teeth of the inner tooth system 17 are cross-sectionally triangular, the flanks of the teeth forming between them an angle $\alpha$(cf. FIG. 4), which is 120° in the represented embodiment. It is naturally also possible to use a somewhat larger or smaller angle $\alpha$, but in general an angle $\alpha$ of 120° or close to it has proved to be particularly advantageous for such clutches. The represented symmetrical tooth shapes give the possibility for a slip clutch effect in both rotation directions, as is apparent from the double-headed arrow in FIG. 3. As a function of the rotation direction the flanks of the inner tooth system 17 and locking teeth 16 facing one another in the selected rotation direction engage on one another. FIG. 2 shows a rotation direction of core 3 to the right, i.e. clockwise, the drive taking place by the running out tape. Each spring tongue 15 is driven by tooth system 16,17 and consequently a driving moment is transferred to the toothed wheel 7.

The toothed wheel 7 meshes (directly or optionally with the interposing of a further intermediate toothed wheel) with a not shown gear wheel fitted to the pivot pin of the take-up reel and which is used for driving the latter. The transmission ratio is such that even when there is a full tape supply on the dispenser reel the speed of the latter is always higher than the speed of the gear wheel 7 given by the take-up reel, so that when using the device its speed is always somewhat smaller than the unwinding speed of the core 3 forced through the removal of the carrier tape, said speed difference being compensated by the slip clutch.

Figure 4:
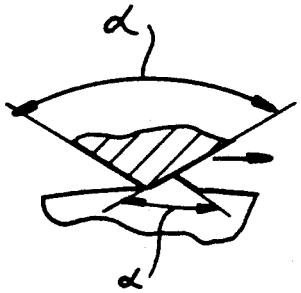
FIGS. 4, 5 and 6 show the time sequence of tooth engagement shown on a locking tooth and a tooth of the inner tooth system on the case of a locking change (slip effect).

In the case of the embodiment shown in FIG. 4 the pitch t of the locking teeth 16 is the same as the pitch T of the inner tooth system 17, so that always two juxtaposed teeth of the inner tooth system 17 engage with two juxtaposed locking teeth 17 fitted to a spring tongue 15. The height $H_2$ of the teeth of the inner tooth system 17 is three times as large as the height $H_1$ of the locking teeth 16, so that, in the case of satisfactory operation, it is possible to achieve a considerable reduction of the thickness of the all-round supporting wall of the reel core 3 and consequently also a significant material saving.

Between two circumferentially juxtaposed spring tongues 15 is provided a gap with a width A, which is significantly smaller than the spacing T between two juxtaposed teeth of the outer tooth system 17, so that between two circumferentially following spring tongues 15 only one tooth of the outer tooth system 17 is without locking engagement or support on a spring tongue. Thus, over the entire circumference there is a particularly large number of locking engagements on the teeth of the inner tooth system 17 of reel core 3, so that the individual loading per tooth engagement can be kept particularly small.

Figure 5:
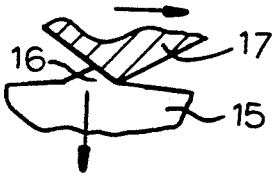
Figure 6:
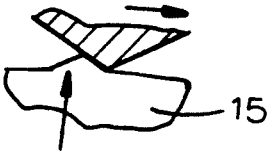
Figure 7:
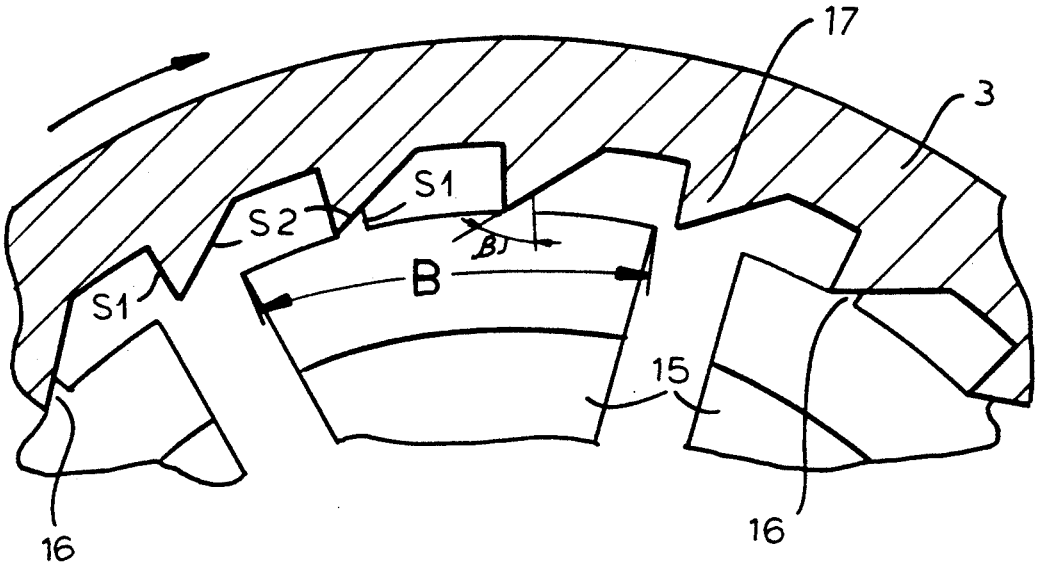
FIG. 7 is a larger scale view corresponding to FIG. 3, but with an assymmetrical, one-sided blocking tooth form.
Figure 8:
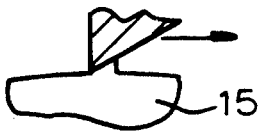
FIGS. 8, 9 and 10 are details corresponding to FIGS. 4, 5 and 6, but with the tooth form or shape according to FIG. 7.

FIGS. 5,6 and 7 show the sequence of processes occurring in the case of a given tooth engagement point when the release moment for the slip clutch is exceeded. The fully juxtaposed flanks of a locking tooth and a tooth of the inner tooth system in the initial position thereof (FIG. 4) are radially increasingly moved away from one another in the case of a high transmission moment due to an elastic springing in of the locking tooth 16, so that the flanks, starting from the particular tooth crest, coincide over a constantly decreased length until finally the springing out is so great (FIG. 5), that the crest of the tooth of the inner tooth system springs over the crest of the locking tooth and consequently momentarily the force closure between the two teeth, i.e. the locking action, is removed, so that the tooth of the inner tooth system 17 can slide down with its second flank along the other flank of the locking tooth 16 and simultaneously the spring tongue 15 springs radially outwards again in the direction of the arrow in FIG. 6 and through its pressure accelerates the sliding down of the opposite tooth. The inner tooth system 17 can move unhindered in the drive direction relative to the spring teeth 15 until its forward flank in the drive direction again engages on the facing flank of the following locking tooth.

Figure 9:
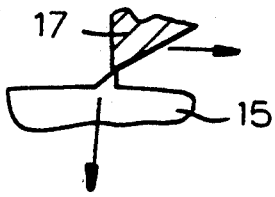
Figure 10:
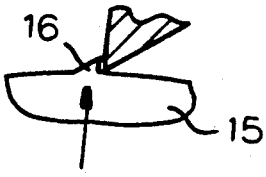

In the case of the sliding down of the tooth of the inner tooth system 17 on locking tooth 16 after the release of the locking engagement, as shown in FIG. 6, due to the constantly acting tape tension and the effect caused by the bevel and the effect accelerating the "slipping" of the outer tooth, there is a brief tape slackening for as long as this "downward sliding" of the two tooth flanks towards one another lasts, which in many cases is admissible and causes no problems, but in other cases should be avoided. This can take place by an appropriate choice of a tooth form or shape, as shown in FIG. 7. Each of the teeth of the inner tooth system 17 and also the locking teeth 16 then have a trailing side flank S1, which is arranged purely radially or is only inclined by a small angle to the radial, whilst the leading side flank S2 of the cross-sectionally triangular tooth is set at an angle $\beta$ thereto and which in the represented embodiment is 60°. As soon as the springing point of the two teeth is reached (cf. FIG. 9) when the sloping flanks S2 rest on one another (in the driving direction of core 3) on exceeding the release moment for the slip clutch, due to the radial alignment of the then engaging flanks S1 the springing out process of spring tongue 15 no longer leads to the tooth of the inner tooth system 17 undergoing any force component acting in the drive direction of core 3 due to the springing out force of the spring tongue, so that the brief tape slackening occurring with the tooth shape of FIG. 3 cannot occur here. Simultaneously, as a result of the radially juxtaposed flanks S1, following the springing out of the spring tongue 15 (i.e. in the position shown in FIG. 10) they are positively blocked in the opposite direction, i.e. a rotation of the driving direction of core 3 would no longer give a slip clutch effect. Thus, the arrangement shown in FIG. 7 only acts in the direction of the one-sided arrow (namely clockwise) as a slip clutch, whereas it acts as a rigid gear in the opposite direction.

The width B of each spring tongue 15 is, as shown in FIG. 7, much greater than the spacing T (cf. FIG. 3) between two teeth of the outer tooth system 17 and is preferably larger than double the spacing T, so that always two teeth of the inner tooth system 17 engage with each spring tongue 15 and a one-sided springing out of a tongue 15 is not possible.

We claim:

1. A tape dispenser comprising:

a housing;

a reel core rotatable in the housing about an axis and having an inner periphery formed with an annular array of inwardly directed core teeth;

a drive wheel rotatable in the housing about the axis;

a plurality of elastically deformable and axially elongated spring tongues formed unitarily with each other and each extending at an acute angle to the axis from a respective inner end fixed to the drive wheel to a respective outer end lying within the reel core adjacent the inner periphery thereof and offset axially from the respective inner end, each inner end being axially offset and radially inwardly offset from the respective outer end, each outer end being integrally formed with at least one tongue tooth engaging between the core teeth; and a supply of tape wound on the reel core, whereby when the tape is payed out or wound up on the reel core it rotates relative to the drive wheel and the core teeth move angularly relative to the tongue teeth with elastic inward deflection of these tongue teeth.

2. The dispenser defined in claim 1 wherein the teeth are of symmetrical cross section.

3. The dispenser defined in claim 1 wherein each tooth has a pair of flanks forming an angle of about 120°.

4. The dispenser defined in claim 1 wherein each tongue tooth has a predetermined radial height and each core tooth has a radial height equal to about three times the radial height of the tongue teeth.

5. The dispenser defined in claim 1 wherein the core teeth each have one flank extending generally radially and directed in one angular direction and another inclined flank, the tongue teeth being complementarily formed but with their radially extending flanks directed in the opposite angular direction, whereby one-way ratcheting only is possible between the core and drive wheel.

6. The dispenser defined in claim 5 wherein the inclined flanks of the teeth extend at about 60° to the respective radially extending flanks.

7. The dispenser defined in claim 1 wherein each tongue outer end has a predetermined angular dimension and the tongue teeth are spaced angularly by at least half this angular dimension, whereby each tongue has at least two tongue teeth.

8. The dispenser defined in claim 1 wherein the reel and the spring tongues are made of plastic.

9. The dispenser defined in claim 1 wherein the spring tongues have outer surfaces lying on a frustocone centered on the axis.

10. The dispenser defined in claim 1 wherein the spring tongues are separated angularly from one another by spacings having a predetermined angular dimension, the core teeth being angularly set at a spacing substantially greater than this angular dimension.

11. The dispenser defined in claim 1 wherein the core teeth extend axially generally the full axial length of the core and are axially substantially longer than the tongue teeth.

12. The dispenser defined in claim 11 wherein the tongue teeth engage noncentrally adjacent one axial end of the core teeth.

13. The dispenser defined in claim 1 wherein the spring tongues are substantially thicker at their outer ends than at their inner ends and between their inner ends and their outer ends.

14. The dispenser defined in claim 1 wherein the spring tongues extend at angle of between 15° and 20° to the axis.

15. A tape dispenser comprising:

a housing;

a reel core rotatable in the housing about an axis and having an inner periphery formed with an annular array of inwardly directed core teeth each of a predetermined relatively great radial dimension and set at a predetermined pitch;

a drive wheel rotatable in the housing about the axis;

a plurality of elastically deformable and axially elongated spring tongues formed unitarily with each other and with the drive wheel, each spring tongue extending at an angle to the axis from a respective inner end fixed to the drive wheel to a respective outer end lying within the reel core adjacent the inner periphery thereof and offset axially from the respective inner end, each inner end being axially offset and radially inwardly offset from the respective outer end, each outer end being integrally formed with at least two tongue teeth engageable with the core teeth, the tongue teeth being each of a predetermined relatively small radial dimension and set at the same pitch as the core teeth; and a supply of tape wound on the reel core, whereby when the tape is payed out or wound up on the reel core it rotates relative to the drive wheel and the core teeth move angularly relative to the tongue teeth with elastic inward deflection of these tongue teeth.

16. A tape dispenser comprising:

a housing formed with a pair of trunnions centered on an axis and with a support rim;

a drive wheel rotatable in the housing on the trunnions about the axis and formed with another support rim axially confronting and spaced from the support rim of the housing;

a cup-shaped reel core rotatable in the housing on the support rims for rotation about the axis and having an inner periphery formed with an annular array of inwardly directed and axially extending core teeth;

a plurality of elastically deformable and axially elongated spring tongues formed unitarily with the drive wheel and each extending at an angle to the axis from a respective inner end fixed at the drive wheel to a respective outer end lying within the reel core adjacent the inner periphery thereof and offset axially from the respective inner end, each inner end being axially offset and radially inwardly offset from the respective outer end, each outer end being integrally formed with at least one tongue tooth engaging between the core teeth; and a supply of tape wound on the reel core, whereby when the tape is payed out or wound up on the reel core it rotates relative to the drive wheel and the core teeth move angularly relative to the tongue teeth with elastic inward deflection of these tongue teeth.

* * * * *